US009598955B2

(12) United States Patent
Gajji et al.

(10) Patent No.: US 9,598,955 B2
(45) Date of Patent: Mar. 21, 2017

(54) WELLBORE TUBULAR LENGTH DETERMINATION USING PULSE-ECHO MEASUREMENTS

(71) Applicant: Halliburton Energy Services, Inc., Houston, TX (US)

(72) Inventors: Bhargav Gajji, Maharashtra (IN); Ankit Purohit, Madhya Pradesh (IN); Ganesh Shriniwas Pangu, Maharashtra (IN); Keshav Parashuram Pujeri, Belgaum (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/033,539

(22) PCT Filed: Dec. 23, 2013

(86) PCT No.: PCT/US2013/077522
§ 371 (c)(1),
(2) Date: Apr. 29, 2016

(87) PCT Pub. No.: WO2015/099663
PCT Pub. Date: Jul. 2, 2015

(65) Prior Publication Data
US 2016/0265351 A1 Sep. 15, 2016

(51) Int. Cl.
*E21B 47/18* (2012.01)
*E21B 47/04* (2012.01)
(Continued)

(52) U.S. Cl.
CPC ..... *E21B 47/18* (2013.01); *E21B 47/00* (2013.01); *E21B 47/04* (2013.01); *E21B 47/091* (2013.01);
(Continued)

(58) Field of Classification Search
CPC ..... E21B 47/18; E21B 47/00
See application file for complete search history.

(56) References Cited

U.S. PATENT DOCUMENTS 4,584,676 A 4/1986 Newman
4,976,143 A 12/1990 Casso
(Continued)

OTHER PUBLICATIONS

International Search Report and the Written Opinion of the International Search Authority, or the Declaration, Jun. 3, 2014, PCT/US2013/077522, 11 pages, ISA/US.

*Primary Examiner* — Curtis Odom
(74) *Attorney, Agent, or Firm* — Haynes and Boone, LLP

(57) ABSTRACT

Systems and methods are disclosed for obtaining distance related wellbore parameters using pulse-echo measurements. For example, the depth of a wellbore may be computed and/or the length of a tubular string positioned in a wellbore may be determined. In an embodiment, a pulsar is deployed into a wellbore along a length of tubular. Once deployed, a fluid pulse is sent form a surface pulse generator and the transmission time is recorded. The downhole pulsar receives the fluid pulse and, in response, returns a second fluid pulse back to the surface. Surface processing circuitry receives the second fluid pulse and records the reception time. The processing circuitry then process the data to determine the total time for travel, thereby determining the length of the downhole pipe or other tubing.

13 Claims, 4 Drawing Sheets

(51) Int. Cl.

| | |
|---|---|
| ***E21B 47/09*** | (2012.01) |
| ***E21B 47/00*** | (2012.01) |
| *E21B 7/04* | (2006.01) |
| *E21B 47/024* | (2006.01) |
| *E21B 47/06* | (2012.01) |
| *E21B 49/00* | (2006.01) |

(52) U.S. Cl.
CPC ..... *E21B 7/04* (2013.01); *E21B 47/024* (2013.01); *E21B 47/06* (2013.01); *E21B 49/00* (2013.01)

(56) References Cited

U.S. PATENT DOCUMENTS

| | | | | |
|---|---|---|---|---|
| 5,195,059 | A * | 3/1993 | Hiroshi ..... | G01B 17/00 367/101 |
| 5,581,024 | A | 12/1996 | Meyer, Jr. et al. | |
| 5,715,890 | A | 2/1998 | Nolen | |
| 6,151,961 | A | 11/2000 | Huber et al. | |
| 6,427,785 | B2 | 8/2002 | Ward | |
| 6,874,361 | B1 | 4/2005 | Meltz et al. | |
| 8,040,755 | B2 | 10/2011 | Priest | |
| 8,121,788 | B2 | 2/2012 | Bordakov et al. | |
| 8,122,954 | B2 | 2/2012 | Estes et al. | |
| 2009/0038392 | A1 | 2/2009 | Alfred et al. | |
| 2010/0101861 | A1 | 4/2010 | Chang | |
| 2011/0006910 | A1 | 1/2011 | Camwell et al. | |

* cited by examiner

WELLBORE TUBULAR LENGTH DETERMINATION USING PULSE-ECHO MEASUREMENTS

FIELD OF THE DISCLOSURE

The present disclosure relates generally to downhole depth computation and, more specifically, to systems and methods that use pulse-echo type measurements to determine the length of various downhole tubulars.

BACKGROUND

During various downhole operations, the drill string or other downhole tubular members may stretch over time due to various stresses. For example, a drill string, which may comprise many segments of drill pipe strung end to end, will typically stretch under its own weight. Since depth measurements are routinely based on pipe tallies, the stretching of the pipe can result in depth measurement errors. A pipe tally is a list containing details of tubulars that have been prepared for running or that have been retrieved from the wellbore. Each tubing joint is numbered and the corresponding length and other pertinent details noted alongside. However, after stretching has occurred, operational decisions made based upon these tally-based measurements will also be erroneous. In the era of multilateral wells in ultra-deep drilling, accurate depth measurements are vitally important because an incorrect measurement could well result in damage to nearby wells.

DESCRIPTION OF ILLUSTRATIVE EMBODIMENTS

Illustrative embodiments and related methods of the present disclosure are described below as they might be employed in a system or method to determine downhole tubular length using fluid pulse-echo measurements. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments and related methods of the disclosure will become apparent from consideration of the following description and drawings.

As described herein, illustrative embodiments of the present disclosure track wellbore depths and/or determine the length of downhole tubulars using fluid pulse measurements. The tubulars may be, for example, coiled tubing, drill tubular, cementing casing or production tubular. According to a first generalized method of the present disclosure, a pulsar is deployed into a wellbore along a length of tubular or coiled tubing. Once deployed, a fluid pulse (mud pulse, for example) is sent from a surface pulse generator and the transmission time is recorded. The downhole pulsar receives the fluid pulse and, in response, returns a second fluid pulse back to the surface. Surface processing circuitry receives the second fluid pulse and records the reception time. The processing circuitry then processes the data to determine the total time for travel and, thereby, determines the length of the downhole pipe or other tubing.

In a second generalized method of the present disclosure, a fluid pulse (mud pulse, for example) is sent from a surface pulse generator, down a string of casing, and the transmission time is recorded. When the fluid pulse encounters the bottom of the casing, a second lower amplitude fluid pulse is reflected back toward the surface. Surface processing circuitry receives the second fluid pulse and records the reception time. The processing circuitry then processes the data to determine the total time for travel and, thereby, determines the length of the casing. Accordingly, in both illustrative methods, the measurement of the fluid pulse travel time is a direct indication of the tubular length, which also takes into account the effects of tubular stretch, fluid density variations, and other factors.

Figure 1:
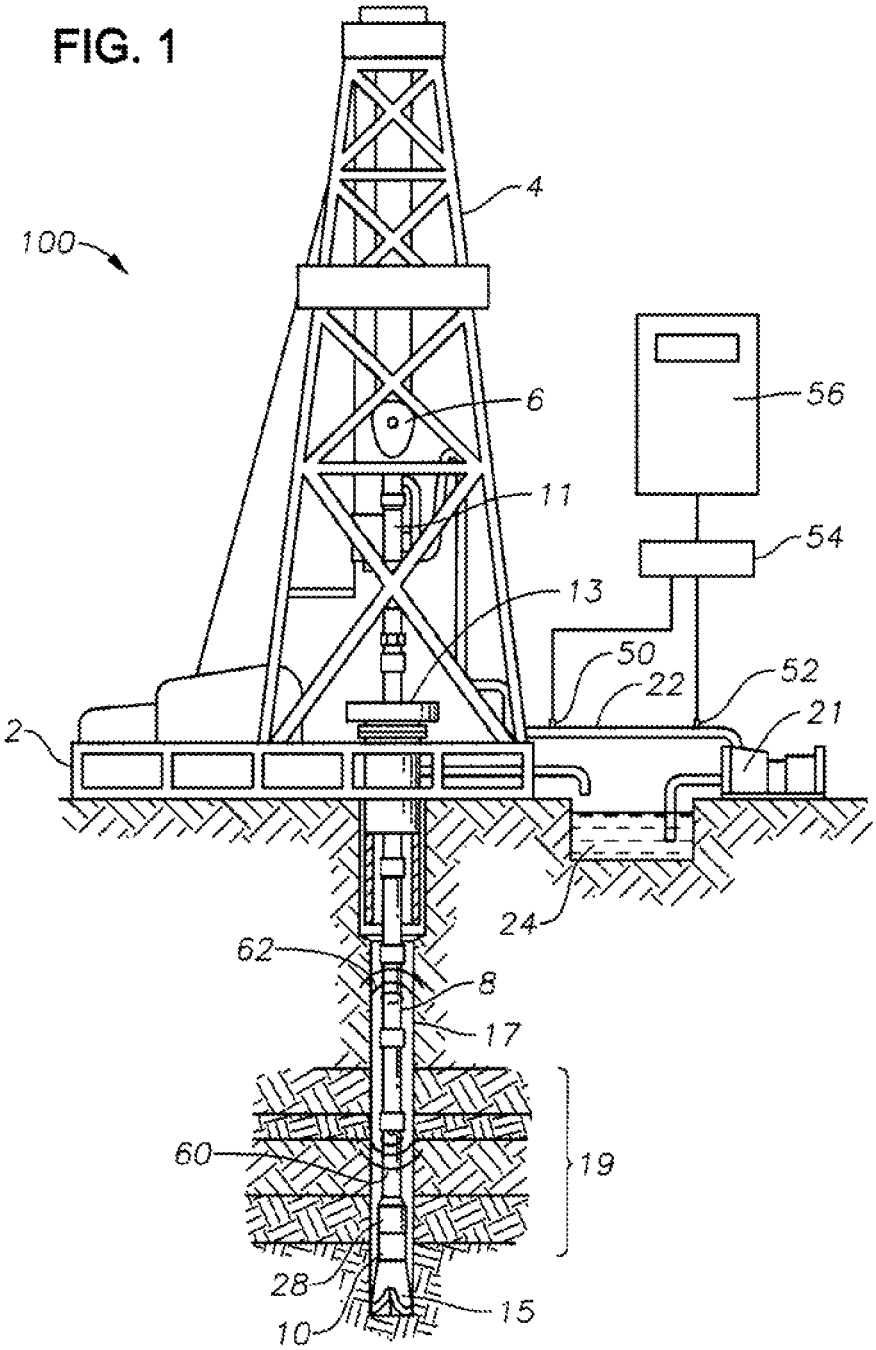
FIG. 1 illustrates a tubular length determination system used to determine the length of a drill string, according to certain illustrative embodiments of the present disclosure.

FIG. 1 illustrates a tubular length determination system 100 used with a logging-while-drilling ("LWD") assembly according to certain illustrative embodiments of the present disclosure. Alternatively, system 100 may be embodied within a measurement-while drilling assembly ("MWD") or other desired drilling assembly. Nevertheless, a drilling platform 2 equipped with a derrick 4 that supports a hoist 6 for raising and lowering a drill string 8. Hoist 6 suspends a top drive 11 suitable for rotating drill string 8 and lowering it through well head 13. Connected to the lower end of drill string 8 is a drill bit 15. As drill bit 15 rotates, it creates a wellbore 17 that passes through various formations 19. A pump 21 circulates drilling fluid through a supply pipe 22 to top drive 11, down through the interior of drill string 8, through orifices in drill bit 15, back to the surface via the annulus around drill string 8, and into a retention pit 24. The drilling fluid transports cuttings from the borehole into pit 24 and aids in maintaining the integrity of wellbore 16. Various materials can be used for drilling fluid, including, but not limited to, a salt-water based conductive mud.

In this illustrative embodiment, the downhole assembly employs mud pulse telemetry for LWD, although other pulse-echo type techniques may be used. Nevertheless, a logging tool 10 is integrated into the bottom-hole assembly near the bit 15. In this illustrative embodiment, logging tool 10 is an LWD tool; however, in other illustrative embodiments, logging tool 10 may be used in a coiled tubing-convey logging application. Logging tool 10 may be, for example, an ultra-deep reading resistivity tool. Alternatively, non-ultra-deep resistivity logging tools may also be used in the same drill string along with the deep reading logging tool. Moreover, in certain illustrative embodiments, logging tool 10 may be adapted to perform logging operations in both open and cased hole environments.

Still referring to FIG. 1, as drill bit 15 extends wellbore 17 through formations 19, logging tool 10 collects measurement signals relating to various formation properties, as well as the tool orientation and various other drilling conditions. In certain embodiments, logging tool 10 may take the form of a drill collar, i.e., a thick-walled tubular that provides weight and rigidity to aid the drilling process. However, as described herein, logging tool 10 includes an induction or propagation resistivity tool to sense geology and resistivity of formations. A fluid pulsar 28 is included to generate pressurized fluid pulses back to the surface, as will be understood by those ordinarily skilled in the art having the benefit of this disclosure. Although not shown, fluid pulsar 28 also includes a telemetry module to communicate images and measurement data/signals to a surface receiver (i.e., processing unit 56) and to receive commands from the surface. In some embodiments, the telemetry module does not communicate the data to the surface, but rather stores the data for later retrieval at the surface when the logging assembly is recovered.

In this illustrative embodiment, fluid pulsar 28 employs mud pulse telemetry for LWD; although other embodiments may be used other pulse-echo based techniques. Nevertheless, fluid pulsar 28 modulates a resistance to drilling fluid flow to generate pressure pulses (also referred to herein as "fluid pulses") that propagate through the fluid in wellbore 17 at the speed of sound. In alternate embodiments, however, other devices capable of creating fluid pressure pulses may also be used. For example, a mud siren, which typically creates acoustic waves within drilling fluid could be modified to generate the fluid pressure pulses described herein. Nevertheless, various transducers, such as, for example, transducers 50 and 52, convert the pressure signals into electrical signals for a signal digitizer 54 (e.g., analog to digital converter). While two transducers 50 and 52 (i.e., sensors) are illustrated, a greater number of transducers, or fewer, may be used in other embodiments.

Digitizer 54 supplies a digital form of the pressure signals to computer processing unit ("CPU") 56, which operates in accordance with software (which may be stored on a computer-readable storage medium) to process and decode the received signals). As described below, the resulting data may be further analyzed and processed by CPU 56 to determine the length of a downhole tubular and/or to track downhole depth. In addition, the telemetry data may further be analyzed by CPU 56 to display useful information such as for example, data necessary to obtain and monitor the bottom hole assembly position and orientation, drilling parameters, and formation properties.

CPU 56 is also configured to itself transmit pressure pulses (i.e., fluid pulses) downhole to fluid pulsar 28 using, for example, its own pulse generator. Such a fluid pulsar may be embodied in various forms, such as, for example, pump 21 or some other fluid obstructor configured to propagate pressure waves down the wellbore. Accordingly, as will be described in more detail below, during operation of illustrative embodiment of FIG. 1, CPU 56 transmits a signal to its pulse generator to transmit a first fluid pulse (e.g., mud pulse) downhole toward fluid pulsar 28, and also records the transmission time of the first fluid pulse. Fluid pulsar 28 receives the first fluid pulse via its sensor (e.g., transducer), and fluid pulsar 28 interprets the fluid pulse as a request to transmit a second fluid pulse. Therefore, in response to receiving the first fluid pulse, fluid pulsar 28 transmits a second fluid pulse back toward the surface that is ultimately received and digitized by one or more of transducers 50,52 and 54, respectively. CPU 56 then detects reception of the second fluid pulse and records the reception time. Thereafter, CPU 56 processes the total travel time of the first and second fluid pulses to thereby determine the length of the desired downhole pipe or tubing.

In alternate embodiments, sensors 50,52 may be located at positions other than the surface. For example, sensors 50,52 may be located at the wellhead or pump 21, or any other desired position along the wellbore above pulsar 28. As a result, any desired length along string 8 may be measured based upon the position of the sensors.

It should also be noted that CPU 56 includes at least one processor and a non-transitory and computer-readable storage, all interconnected via a system bus. Software instructions executable by the processor for implementing the illustrative length determination and/or depth tracking methods described herein in may be stored in local storage or some other computer-readable medium. It will also be recognized that the same software instructions may also be loaded into the storage from a CD-ROM or other appropriate storage media via wired or wireless methods.

Moreover, those ordinarily skilled in the art will appreciate that various aspects of the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing, devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Figure 2:
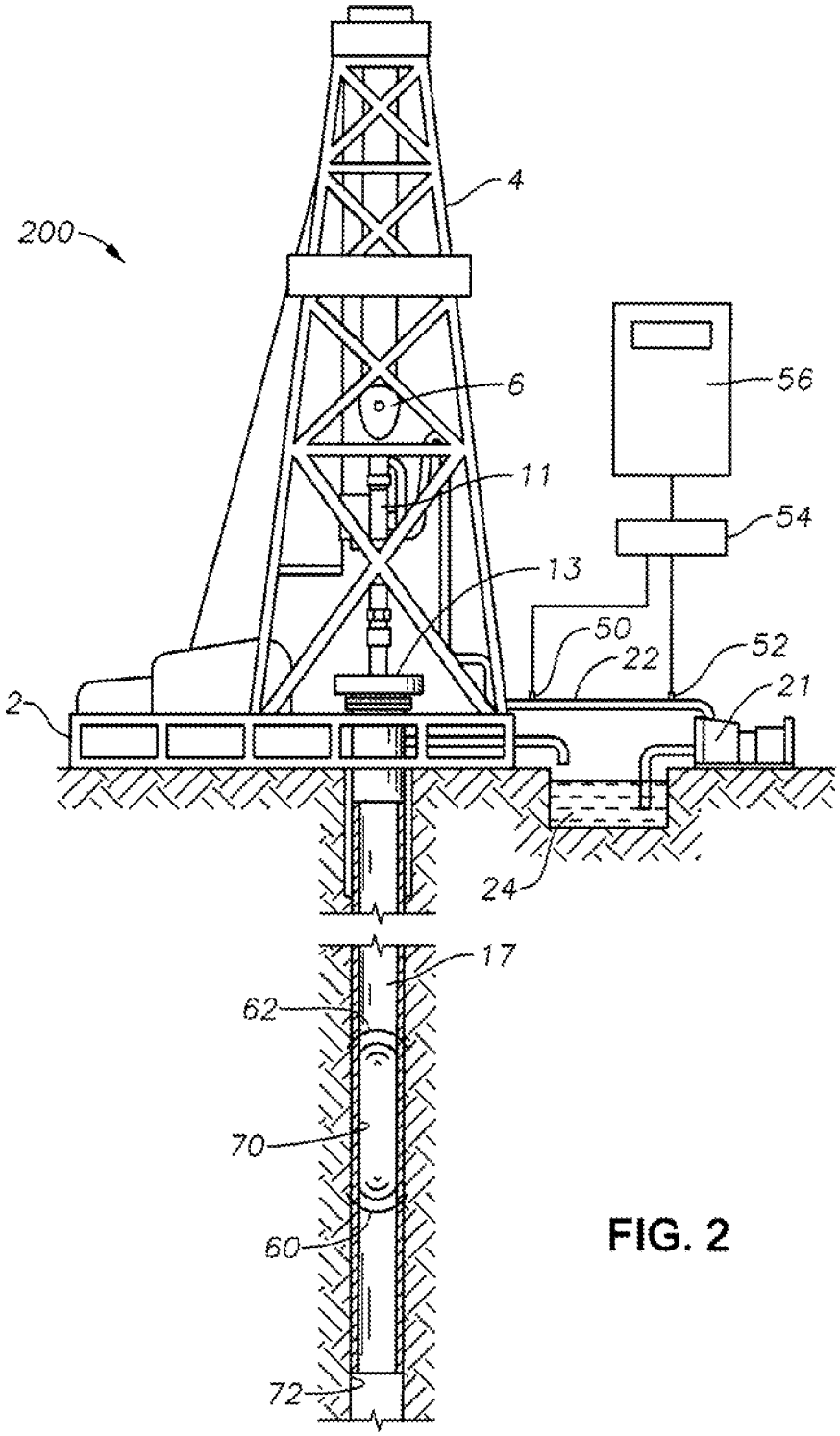
FIG. 2 illustrates a tubular length determination system utilized to determine the length of a casing string, according to certain illustrative embodiments of the present disclosure.

FIG. 2 illustrates a tubular length determination system 200 used to determine the length of casing, according to certain illustrative embodiments of the present disclosure. Tubular length determination system 200 is somewhat similar to tubular length determination system 100 and, therefore, may be best understood with reference thereto. Where like numerals indicate like elements. In contrast to tubular length determination system 100, tubular length determination system 200 does not use pulsar 28 to determine the length of the casing string. As shown in FIG. 2, a string of casing 70 has been positioned in wellbore 17 using any suitable technique. As will be understood by those ordinarily skilled in the art having, the benefit of this disclosure, at various times during the drilling process, drill string 8 may be removed from the borehole as shown in FIG. 2. Thereafter, the length of casing 70 may be determined. Alternatively, however, the length of casing 70 may also be determined while the drill string, is still deployed in wellbore 17.

As will be described in more detail below, during operation of illustrative embodiment of FIG. 2, CPU 56 transmits a first fluid pulse (e.g., mud pulse) downhole toward the bottom 72 of casing 70, and records the transmission time of the first fluid pulse. Due to the cross-section changes along the inner diameter of casing 70 (i.e., reflection points), waves of the first fluid pulse will be reflected back toward the surface as the reflection points are encountered. Such cross-sectional changes in the diameter of casing 70 may be caused by a variety of things including, for example, the points along casing 70 where the size of the casing changes, connections, or the bottom of the casing. The reflected waves will have a lower amplitude than the first fluid pulse. As such, the amplitude of the first fluid pulse transmitted by CPU 56 must have a sufficiently high amplitude so that the reflected wave(s) can be detected. In certain embodiments, the amplitude of the first fluid pulse may be 100-300 psi.

Nevertheless, after CPU 56 transmits the first fluid pulse, it travels down casing 70 until it encounters the bottom 72, where a second fluid pulse is then reflected back up wellbore 17 toward the surface, where it is ultimately received and digitized by one or more of transducers 50,52 and 54, respectively. CPU 56 then detects reception of the second fluid pulse and records the reception time. Thereafter. CPU 56 processes the total travel time of the first and second fluid pulses to thereby determine the length of casing 70.

Now that various illustrative embodiments of the present disclosure have been generally described, a more detail discussion of the method by which tubular lengths are determined and downhole depths are tracked will now be described. As previously mentioned, the present disclosure describes a method in which tubular lengths and downhole depths are analyzed based upon the time required for a downhole fluid pulse during drilling, logging, or any other operation. This measurement of the pulse travel time is a direct indication of a pipe or casing length, which also takes into account the effects of tubular stretch and other possible factors. Therefore, through a determination of the correct depth, deduced from pipe/tubing or casing length, embodiments of the present disclosure provide enhance reliability in drill bit steering in directional wells necessary to avoid damage to nearby wells and to improve the overall accuracy of drilling operations.

Referring back to FIG. 1, when it is desired to track the depth or measure the length of a downhole tubular, tubular length determination system 100 is activated. CPU 56 then transmits a first fluid pulse 60 downhole through wellbore 17 to pulsar 28. In return, pulsar 28 then transmits second fluid pulse 62 back to CPU 56. During this pulse-echo method of fluid pulse travel, CPU 56 measures the total travel time for the fluid pulses from the surface and back to the surface. When determining the total travel time. CPU 56 considers the delay caused by processing time associated with pulsar 28 and CPU 56. In certain embodiments, the processing delay may be known apriori from surface testing.

Referring back to FIG. 2, when it is desired to measure the length of casing 70, tubular length determination system 200 is activated. CPU 56 then transmits a first fluid pulse 60 downhole through wellbore 17 toward the bottom 72 of casing 70. Once bottom 72 is encountered, a second fluid pulse 62 is reflected back to CPU 56. During this pulse-echo method of fluid pulse travel, CPU 56 measures the total travel time for the fluid pulses from the surface and back to the surface. When determining the total travel time. CPU 56 also considers the delay caused by processing time associated with CPU 56.

In addition to the processing delays, certain illustrative embodiments of CPU 56 also accounts for density variations in the wellbore fluid (e.g., drilling mud) due to hydrostatic pressures at various depths. As will be understood by those ordinarily skilled persons mentioned herein, the density variations of the fluid due to pressure is dependent upon depth with the variations being small, thus allowing use of approximate depth evaluation readily available from the predicted path for the drilling process. Those same density variations are then used by CPU 56 to determine the average velocity of first and second fluid pulses 60,62. Ultimately, the pulse travel time is the enabler for the determination of the pipe length. Thus, by accounting for the density variation we can achieve better accuracy in the length. In certain embodiments, such evaluations are done at the surface, rather than at the down hole which helps the data transfer requirements from downhole. Additionally, the empirical equations based on theory of density variation with depth can be created and compiled in CPU 56 for execution, which will take into account the effect of density variation with depth. The velocity of the wave travel will be affected by the density and would be properly taken care of by the empirical equations.

Ultimately, tubular length determination system 100,200 processing the total travel time of the fluid pulses, in addition to the effects on that time by processing delays and fluid density variations, in order to thereby determine the length in which the fluid pulses 60,62 have traveled. Thereafter, CPU 56 in turn correlates this length to the length of the pipe, tubing or casing, including any stretching of the pipe, tubing or casing which might have occurred over time. In one illustrative embodiment, CPU 56 uses Equation (1) below to determine the lengths, which can be represented as:

$$l=(v\times\Delta t^{l})/2 \qquad \text{Eq. (1)},$$

where $\Delta t$ is the total time for fluid pulse travel, $\Delta t^{l}$ is the corrected time for fluid pulse travel, v is the average velocity of the fluid pulse, l is the length of the pipe/tubing/casing (including pipe/tubing/casing stretch).

Additionally, it should be noted that the accuracy of the length measurement of the tubular will depend on the resolution capability CPU 56. Thus, in certain illustrative embodiments, CPU 56 has a resolution of at least 10K samples/second. The speed of CPU 56 will decide the error in the evaluation of the time difference between the departure and arrival of the pulse/pressure. Therefore, the higher the speed of the CPU 56, the higher will be accuracy.

Figure 3:
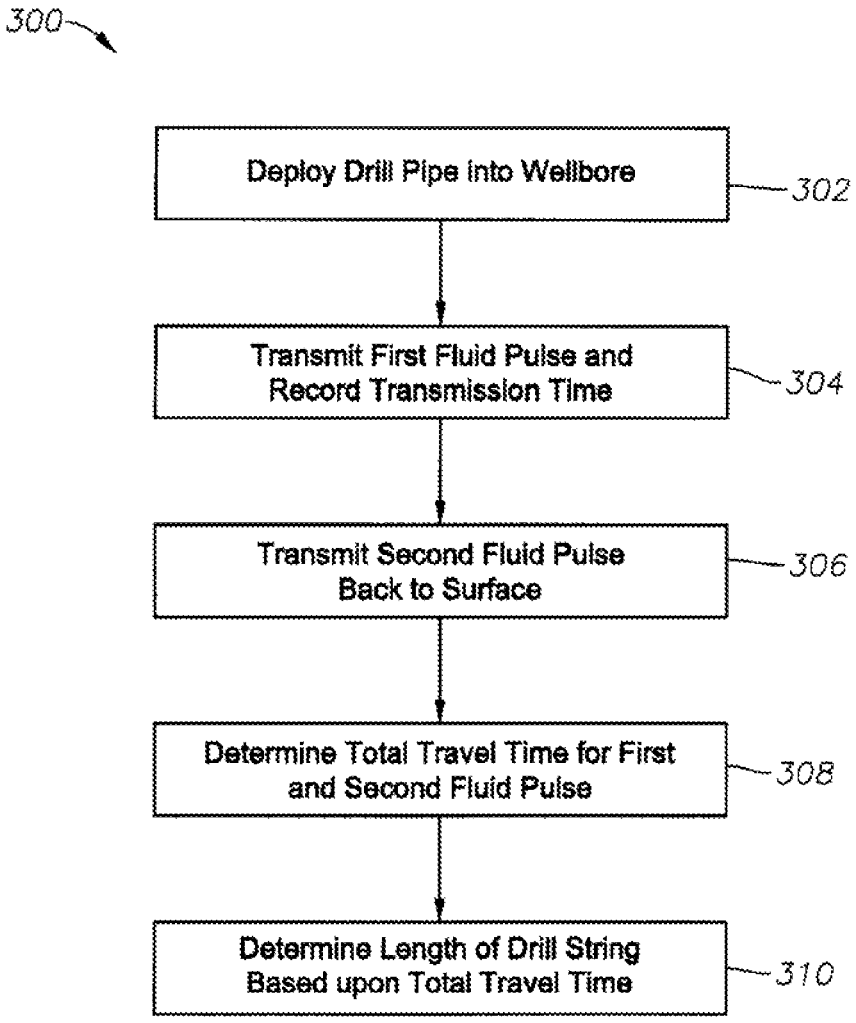
FIG. 3 is a flow chart detailing a drill pipe length determination method according, to certain illustrative methods of the present disclosure.

FIG. 3 is a flow chart detailing a drill pipe length determination method 300 according to certain illustrative methods of the present disclosure. With reference to FIGS. 1 and 3, tubular length determination system 100 has been deployed in a LWD application at block 302. In this example, during drilling, the length of drill string 8 has been stretched. Alternatively, however, drill string 8 may be coiled tubing. Nevertheless, as a result, the predetermined, length of drill string 8 is no longer sufficient to accurately determine the wellbore depths. Thus, at block 304, CPU 56 sends a signal to a pulse generator (i.e., first pulse generator) to generate and transmit first fluid pulse 60 down wellbore 17 to a sensor (i.e., first sensor) utilized by fluid pulsar 28, and records the transmission time. The pulse generator may take a variety of forms, such as, for example, the mud pump or a flow obstructor. The sensor may also take a variety of forms, such as, for example, a pressure transducer.

First fluid pulse 60 then propagates through wellbore fluid present within wellbore 17. The wellbore fluid may be a variety of fluids, such as, for example, drilling or completion fluids. Once fluid pulsar 28 receives first fluid pulse 60 at its sensor, it decodes the pulse as a request to transmit second fluid pulse 62, thus causing a processing delay. In certain embodiments, an analog circuit may be used to determine the delay, while in other embodiments the delay may be known by testing the circuits and tools in a lab. Thereafter, CPU 56 may add or subtract the time.

At block 306, fluid pulsar 28 (i.e., second pulse generator) then transmits second fluid pulse 62 back up through the wellbore fluid of wellbore 17 to the surface, where it is received by transducers 50,52, (i.e., second sensor) processed by digitizer 54, and communicated to CPU 56, as described herein. Once the measurement signal is received by CPU 56, CPU 56 records the reception time of the second fluid pulse 62, incurring further processing delays. At block 308, CPU 56 then determines the total travel time of first and second fluid pulses 60,62, while also taking into account the effects on the total travel time caused by all processing delays of pulsar 28 and CPU 56 and variations in the density of the wellbore fluid, as described above. At block 310, CPU 56 determines the length of drill string 8 based upon the total travel time.

Note also that in alternative embodiments, the pulse generators and sensors described herein may be embodied in a single component or may be separate components, as will be understood by those ordinarily skilled in the art having the benefit of this disclosure.

Figure 4:
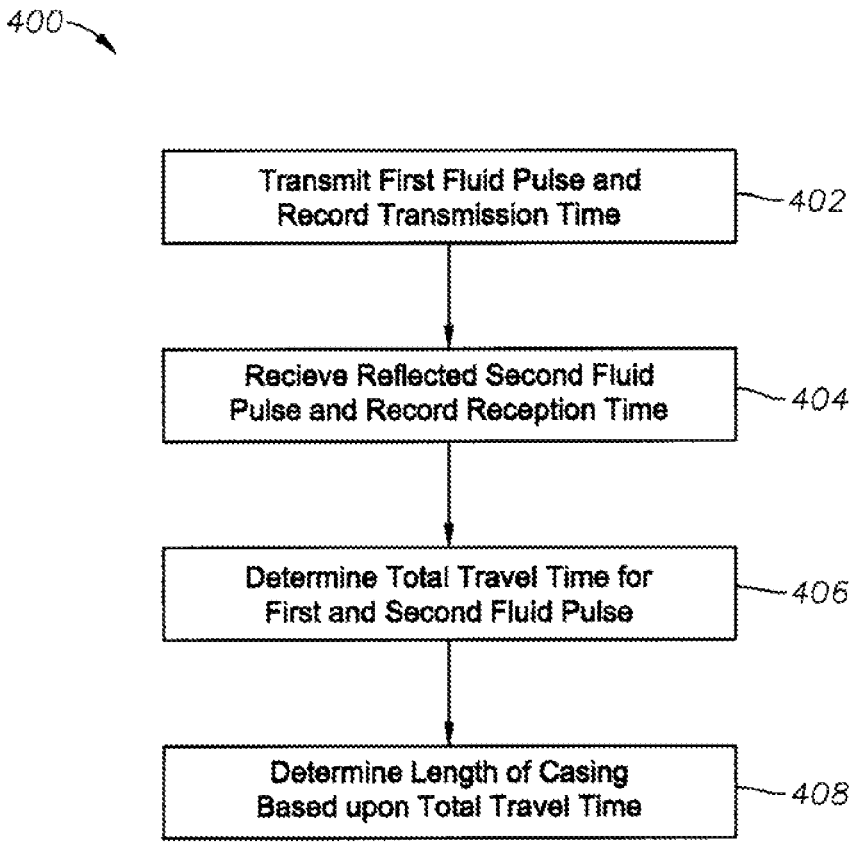
FIG. 4 is a flow chart detailing as casing length determination method according to certain illustrative methods of the present disclosure.

FIG. 4 is a flow chart detailing a casing length determination method 400 according to so certain illustrative methods of the present disclosure. In this example, casing 70 may or may not have been stretched. With reference to FIGS. 2 and 4, tubular length determination system 200 has been activated at block 402, where CPU 56, via a pulse generator as previously described, transmits first fluid pulse 60 down wellbore 17 toward bottom 72 of casing 70, and records the transmission time. First fluid pulse 60 then propagates through wellbore fluid present within wellbore 17. The wellbore fluid may be a variety of fluids, such as, for example, drilling or completion fluids. Once first fluid pulse 60 encounters bottom 72, a second fluid pulse 62 is then reflected back up through the wellbore fluid of wellbore 17 to the surface, where it is received by transducers 50,52, processed by digitizer 54, and communicated to CPU 56, as described herein. Once the measurement signal is received by CPU 56, CPU 56 records the reception time of the second fluid pulse 62 at block 404, incurring processing delays. At block 3406, CPU 56 then determines the total travel time of first and second fluid pulses 60,62, while also taking into account the effects on the total travel time caused by all processing delays of CPU 56 and variations in the density of the wellbore fluid, as described above. At block 408, CPU 56 determines the length of casing 70 based upon the total travel time.

In other illustrative embodiments, tubular length determination system 100,200 may continuously track the depth and length of various tubulars as it is being deployed downhole or during the life of the well. Also, in addition to using the fluid pulses reflected from the bottom of the casing, tubular length determination system 200 may also use fluid pulses reflected from other cross-sectional changes along casing 70 to determine the length of certain portions of casing 70, as will be understood by those ordinarily skilled in the art having the benefit of this disclosure.

Using the length measurements determined using embodiments of the present disclosure, a variety of wellbore operations may be performed. For example, drilling, decisions such as landing, geosteering, well placement or geostopping decisions may be performed. In the case of landing directional wells, as the bottom hole assembly drilling the well approaches the reservoir from above, exact location of nearby wells can be avoided, thus improving the accuracy of drilling operations. In the case of well placement, the wellbore may be kept inside the reservoir at the optimum position, preferably closer to the top of the reservoir to maximize production. In the case of geostopping, drilling may be stopped before penetrating a possibly dangerous zone or nearby well.

Embodiments described herein further relate to any one or more of the following paragraphs:

1. A method comprising transmitting a first fluid pulse along a wellbore using a first pulse generator; receiving the first fluid pulse at a first sensor positioned along the tubular; in response to the received first fluid pulse, transmitting a second fluid pulse back along the wellbore to a second sensor using a second pulse generator positioned along the tubular; receiving the second fluid pulse at the second sensor; determining a total travel time for the first and second fluid pulses; and determining a length along the tubular based upon the total travel time.

2. A method as defined in paragraph 1, wherein the wellbore contains drilling or completion fluid.

3. A method as defined in any of paragraphs 1-2, wherein the first pulse generator and second sensor are located; at or adjacent to a surface location; or at a position along the tubular above the second pulse generator.

4. A method as defined in any of paragraphs 1-3, wherein the tubular comprises at least one of coiled tubing, drill pipe or production pipe.

5. A method as defined in any of paragraphs 1-4, wherein the tubular has been stretched.

6. A method as defined in any of paragraphs 1-5, wherein the determining the total travel time comprises accounting, for a processing delay.

7. A method as defined in any of paragraphs 1-6, wherein determining the total travel time comprises accounting for density variations in the fluid due to hydrostatic pressure at various depths.

8. A method as defined in any of paragraphs 1-7, further comprising determining an average velocity of the first and second fluid pulses using the density variations in the fluid.

9. A method as defined in any of paragraphs 1-8, wherein determining the length comprises using an equation represented by $l=(v\times\Delta t1)/2$.

10. A method for determining downhole tubular length, the method comprising transmitting a first fluid pulse along downhole casing using a pulse generator located at a surface; receiving the first fluid pulse at a reflection point along an inner diameter of the casing, whereby a second fluid pulse is reflected back toward the surface; receiving the second fluid pulse determining a total travel time of the first and second fluid pulses; and determining a length of a casing using the total travel time.

11. A method as defined in paragraph 10, wherein the reflection point is the bottom of the casing.

12. A method as defined in any of paragraphs 10-11, wherein determining the total travel time comprises accounting for at least one of a processing delay or density variations in the fluid along the wellbore.

Moreover, any of the methods described herein may be embodied within a system comprising processing circuitry to implement any of the methods, or a in a computer-program product comprising instructions which, when executed by at least one processor, causes the processor to perform any of the methods described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A method comprising:

transmitting a first fluid pulse along a wellbore using a first pulse generator;

receiving the first fluid pulse at a first sensor positioned along a tubular in the wellbore;

in response to the received first fluid pulse, transmitting a second fluid pulse back along the wellbore to a second sensor using a second pulse generator positioned along the tubular in the wellbore;

receiving the second fluid pulse at the second sensor;

determining a total travel time for the first and second fluid pulses; and determining a length along the tubular in the wellbore based upon the total travel time.

2. A method as defined in claim 1, wherein the wellbore contains drilling or completion fluid.

3. A method as defined in claim 1, wherein the first pulse generator and second sensor are located:

at or adjacent to a surface location; or at a position along the tubular in the wellbore above the second pulse generator.

4. A method as defined in claim 1, wherein the tubular in the wellbore comprises at least one of coiled tubing, drill pipe or production pipe.

5. A method as defined in claim 1, wherein the tubular in the wellbore has been stretched.

6. A method as defined in claim 1, wherein the determining the total travel time comprises accounting for a processing delay.

7. A method as defined in claim 1, wherein determining the total travel time comprises accounting for density variations in the fluid due to hydrostatic pressure at various depths.

8. A method as defined in claim 7, further comprising determining an average velocity of the first and second fluid pulses using the density variations in the fluid.

9. A method as defined in claim 1, wherein determining the length comprises using an equation represented by:

$$l=(v\times\Delta t^1)/2$$

wherein l is the length of the pipe/tubing/casing, v is the average velocity of the fluid pulse and $\Delta t^1$ is the corrected time for fluid pulse travel.

10. A system comprising processing circuitry to implement any of the methods in claims 1-9.

11. A method for determining downhole tubular length, the method comprising:

transmitting a first fluid pulse along downhole casing using a pulse generator located at a surface;

receiving the first fluid pulse at a reflection point along an inner diameter of the casing, whereby a second fluid pulse is reflected back toward the surface;

receiving the second fluid pulse;

determining a total travel time of the first and second fluid pulses; and determining a length of a casing using the total travel time.

12. A method as defined in claim 11, wherein the reflection point is the bottom of the casing.

13. A method as defined in claim 11, wherein determining the total travel time comprises accounting for at least one of:

a processing delay; or density variations in the fluid along the wellbore.

* * * * *